US008933337B2

(12) United States Patent
Payan

(10) Patent No.: US 8,933,337 B2
(45) Date of Patent: Jan. 13, 2015

(54) DEVICE FOR PREVENTING THE ESTABLISHMENT OF AN ELECTRIC ARC BETWEEN TWO CONDUCTIVE ELEMENTS

(75) Inventor: Denis Payan, Mervilla (FR)

(73) Assignee: Centre National d'Etudes Spatiales, Paris (FR)

( * ) Notice: Subject to any disclaimer, the term of this patent is extended or adjusted under 35 U.S.C. 154(b) by 356 days.

(21) Appl. No.: 12/736,140

(22) PCT Filed: Mar. 13, 2009

(86) PCT No.: PCT/FR2009/050420
§ 371 (c)(1),
(2), (4) Date: Nov. 30, 2010

(87) PCT Pub. No.: WO2009/122072
PCT Pub. Date: Oct. 8, 2009

(65) Prior Publication Data

US 2011/0073349 A1 Mar. 31, 2011

(30) Foreign Application Priority Data

Mar. 14, 2008 (FR) ..... 08 51657

(51) Int. Cl.
*H01B 3/12* (2006.01)
*H01B 17/00* (2006.01)
*H01R 13/53* (2006.01)

(52) U.S. Cl.
CPC ..... *H01R 13/53* (2013.01)
USPC ..... 174/137 B; 174/137 R

(58) Field of Classification Search
USPC ..... 174/137 B, 137 R
See application file for complete search history.

(56) References Cited

U.S. PATENT DOCUMENTS

| | | | | |
|---|---|---|---|---|
| 2,524,939 | A | 10/1950 | Stephan et al. | |
| 3,806,763 | A * | 4/1974 | Masuda | 361/227 |
| 5,417,594 | A * | 5/1995 | Herman et al. | 439/690 |
| 6,296,523 | B1 * | 10/2001 | Sasai | 439/660 |
| 7,344,395 | B2 * | 3/2008 | Agethen et al. | 439/181 |
| 7,520,768 | B2 * | 4/2009 | Nicholson | 439/190 |
| 7,927,156 | B2 * | 4/2011 | Appel et al. | 439/709 |
| 2004/0130230 | A1 * | 7/2004 | Zilch | 310/113 |
| 2005/0186823 | A1 * | 8/2005 | Ring et al. | 439/322 |
| 2009/0045627 | A1 * | 2/2009 | Cairo et al. | 290/44 |
| 2010/0312135 | A1 * | 12/2010 | Monier | 600/547 |

FOREIGN PATENT DOCUMENTS

| | | |
|---|---|---|
| DE | 1 279 207 | 10/1968 |
| DE | 20 2005 017 012 U1 | 1/2006 |
| DE | 202005017012 U1 * | 2/2006 |

(Continued)

*Primary Examiner* — Timothy Thompson
*Assistant Examiner* — Charles Pizzuto
(74) *Attorney, Agent, or Firm* — Jacobson Holman PLLC

(57) ABSTRACT

The invention concerns a device for preventing the establishment of an electric arc between adjacent portions (9) having no electrical insulation of at least two electrically conductive elements (7). According to the invention, the device comprises at least one separating partition (13) made of dielectric material inserted between said adjacent portions (9) of said conductive elements (7), the dimensions of said separating partition (13) being adapted so that the shortest path between said adjacent portions (9), by bypassing said separating partition (13), corresponds to an instability threshold for an electric arc that is likely to be established between said adjacent portions.

7 Claims, 3 Drawing Sheets

(56) References Cited

FOREIGN PATENT DOCUMENTS

| | | | | | |
|---|---|---|---|---|---|
| EP | 1 289 075 A2 | | 3/2003 | | |
| EP | 1289075 A2 | * | 3/2003 | ..... | H01R 13/52 |
| JP | 09037569 A | * | 2/1997 | ..... | H02N 1/00 |

* cited by examiner

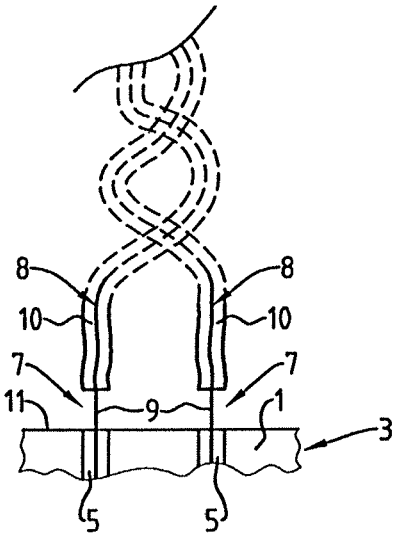
Fig. 1-Prior Art
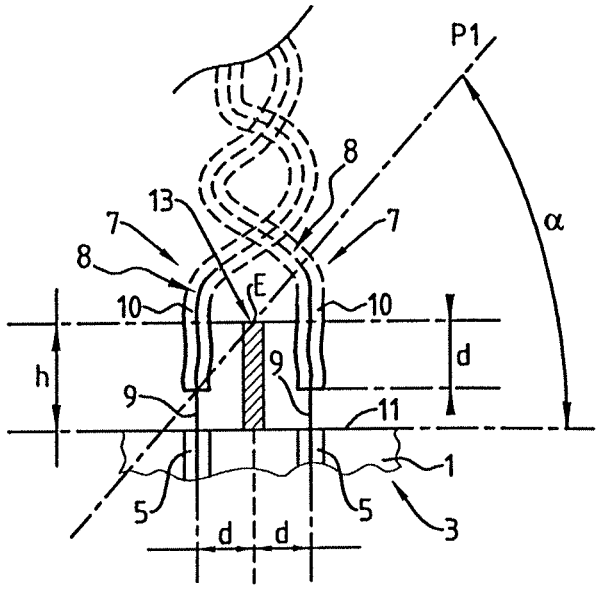
Fig. 2
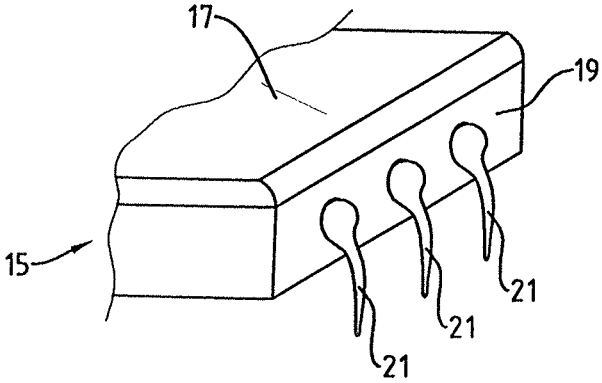
Fig. 3-Prior Art
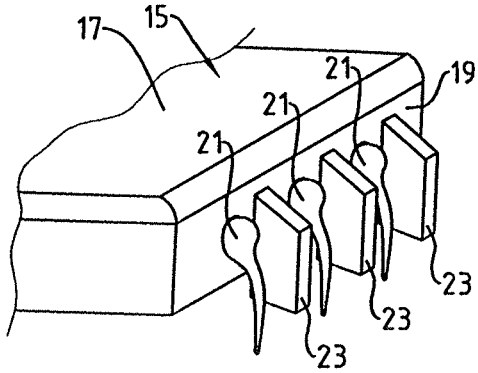
Fig. 4

DEVICE FOR PREVENTING THE ESTABLISHMENT OF AN ELECTRIC ARC BETWEEN TWO CONDUCTIVE ELEMENTS

This is a national stage of PCT/FR09/050420 filed Mar. 13, 2009 and published in French, which has a priority of French no. 08 51657 filed Mar. 14, 2008, hereby incorporated by reference.

The present invention concerns a device for preventing the establishment of an electric arc between two opposite conductive elements.

The invention is particularly applicable in electric or electronic components, such as connectors, used in a spatial environment or under conditions reproducing such an environment. It must, however, be understood that the invention is generally applicable to electric or electronic components intended to be used in any environment where an electric arc is likely to form between two opposite conductive elements.

The electric or electronic components used in a spatial environment are often damaged due to the formation of electric arcs between the conductive elements they include. These conductive elements can for example be plug connectors of a male connector that can be plugged into a female connector or printed circuit tracks.

Such connectors can, for example, be of the type of those described in patent applications FR-2 068 660, US2006/0046568 and US-2003/0008542, and in patent U.S. Pat. No. 3,746,817.

As shown by these documents, the male connectors can include plug-in conductive elements arranged opposite, in particular parallel to each other, that are separated by spaces. These plug-in elements have in common that they have a stripped conductive portion that protrudes in relation to a surface of the male connector body.

During connection of the male connector with the female connector, the plug-in conductive elements, such as the wires or prongs of the male connector, are engaged in receiving housings formed in a female connector body.

Once the connection is made, it is possible that a stripped portion of the conductive elements may remain protruding in relation to the surface of the male and/or female connector body. Even in the case of careful connection, there is often a small stripped portion of the conductive element that does not completely penetrate the housing. This small stripped portion remains directly opposite other stripped portions of other wires or the connector itself, which represents a short-circuit risk if the ambient environment suddenly becomes conductive (ionization of the air, strong humidity, very intense field, creation of a plasma in the vacuum . . . ).

In a land environment where the air constitutes an insulant under normal temperature and pressure conditions, the problem of avoiding the formation of electric arcs between the stripped portions of conductive connector elements generally does not arise, the air being insulating, except in the case of an intense electric field or particular humidity conditions, for example.

In a spatial environment lacking atmosphere, a precursor phenomenon (filament, dust, ESD or electrostatic discharge, high voltage, etc.) is likely to generate a local plasma between the stripped portions of two conductive elements. This local plasma, while expanding, will make the medium conductive and establish a short-circuit between the two conductive elements. In the air, an intense electric field can cause such a plasma to be generated.

The invention therefore aims to prevent the formation of these arcs between two electrically conductive elements.

To that end, the invention concerns a device for preventing the establishment of an electric arc between adjacent portions having no electrical insulation or likely to have no electrical insulation, of at least two electrically conductive elements, this device being remarkable in that it comprises at least one separating partition made of dielectric material inserted between said adjacent portions of said conductive elements, the dimensions of said separating partition being adapted so that the shortest path between said adjacent portions, by bypassing said separating partition, corresponds to an instability threshold for an electric arc that is likely to be established between said adjacent portions.

Thus, the device according to the invention prevents the formation of electric arcs between opposite conductive elements. Indeed, the dimensions of the separating partition made of dielectric material force an electric arc likely to form to follow a path such that the arc is unstable and cannot be established between the two conductive elements.

The invention also makes it possible to protect the conductive elements from any contact during manipulation and can thus prevent electrostatic discharge of human origin.

According to other features of the device according to the invention, taken separately or in combination:

- said separating partition has, perpendicular to the shortest distance separating said partition from each of said adjacent portions of said conductive elements, a height such that its overhang beyond said adjacent parts is at least equal to about half of said distance, which amounts to imposing a slope of about 30° on an arc likely to form in relation to a direct path between the adjacent portions having no electrical insulation of the conductive elements;
- said separating partition is made from a ceramic material;
- in the case where said conductive elements are arranged protruding in relation to a surface of an electrical component, said separating partition is formed by at least one plate extending from said surface;
- in the case where said component includes several conductive elements distributed according to gridlines on said surface, said separating partition is made up of a set of plates forming a grid;
- in the case where said component is a male connector adaptable on a female connector provided with plug-in contacts for said conductive elements, said grid is made up of a set of cells adapted to receive said contacts, respectively;
- said separating partition is fixed on said surface;
- said separating partition is made in a single piece with the housing of said component;
- in the case where said component is a revolving contactor, said plate is substantially disc-shaped.

The invention also concerns an electrical component remarkable in that it includes at least one device as defined above to prevent the establishment of an electric arc.

BRIEF DESCRIPTION OF THE DRAWINGS

The invention will be better understood in light of the embodiments that will now be presented in reference to the appended drawings, in which:

FIG. 1 shows, in diagrammatic cross-section, two conductive elements of a connector, FIG. 2 shows, in diagrammatic cross-section, an application of an embodiment of the device according to the invention to two conductive elements of the connector illustrated in FIG. 1, FIG. 3 is a partial perspective view of a connector equipped with male contacts, FIG. 4 is a partial perspective view of the connector of FIG. 3 equipped with the device according to the invention.

FIGS. 1 and 2 show a connector 3 body 1 having housings 5 formed from its surface 11. The connector 3 body 1 illustrated in FIG. 1 is not equipped with the device according to the invention.

Figure 5:
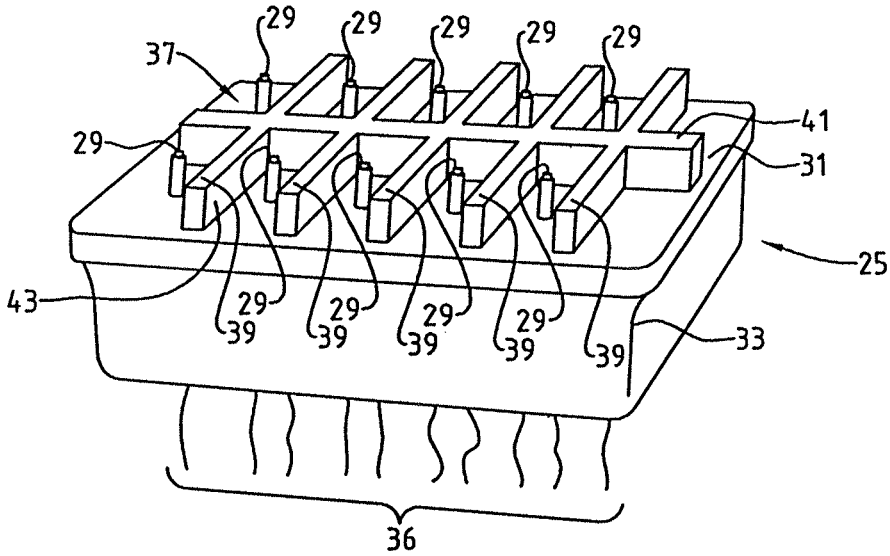
FIG. 5 illustrates another embodiment of the device according to the invention applied to a male connector different from the one illustrated in FIGS. 1 or 3, said device and said connector being shown in perspective.

The housings 5 are adapted to receive conductive elements 7 such as conductive prongs or wires. The conductive elements 7 are made up of a conductive core 8 that is surrounded by an electrically insulating sheath 10, except at one of their ends that ends with a stripped portion 9 intended to be received in a housing 5.

Only two housings 5 are shown in FIGS. 1 and 2. It should however be understood that the connector 3 body 1 can include more than two housings.

The stripped portions 9 of the conductive elements 7 are fixed in the housings 5 using any means known by those skilled in the art, for example welding.

As illustrated in FIGS. 1 and 2, the stripped portions 9 of the core 8 of the conductive elements 7 do not completely penetrate the housings 5 and each have a conductive, portion protruding in relation to the surface 11 of the body 1 of the connector 3.

FIG. 2 shows the connector body 1 equipped with a device according to a first embodiment of the invention.

A separating partition 13 in the form of a plate or rectangular blade, made of a dielectric material, protrudes on the surface 11 of the body 1 mid-way between the two conductive elements 7. The separating partition 13 is fastened by its edge on the surface 11 of the body 1, or made in a single piece therewith.

As indicated in FIG. 2, the dielectric separating partition 13 has a height h in relation to the surface 11 of the body 1.

Preferably, the height h is at least equal to the length of the stripped portion plus an overhang length that is at least equal to half the distance between the two conductive elements 7. Thus, the plane P1 extending between the end of the sheath 10 where the conductive stripped portion 9 of one of the two elements 7 begins and the upper edge E of the separating partition 13 opposite the surface 11 of the body 1 forms an angle a $\alpha$ of at least 30° with said surface 11.

The separating partition 13 prevents the establishment of an electric arc between the two stripped portions 9 of the cores of the electric elements 7, because it forces the electric arc likely to form between said stripped portions to follow a path whereof the radius of curvature makes the arc unstable.

Preferably, the separating partition 13 is made of ceramic to guarantee it a lifetime in compliance with the requirements of the standards in force, in particular in the field of the manufacture of connectors for spatial use.

The invention is not limited to the embodiment of the separating partition 13 described above.

FIG. 4 shows another embodiment of a separating partition according to the invention, which is arranged between two conductive elements of a component 15 illustrated in FIG. 3, such as a microprocessor, a memory module, or others.

The component 15 differs from the connector illustrated in FIGS. 1 and 2 in that it includes a body 17 having a face 19 on which plug-in connection conductive elements 21, such as prongs, protrude, uniformly distributed parallel to each other. These conductive elements 21 are intended to be received and fastened by welding or interlocking into housings of a support device (not shown) such as a printed circuit or others.

According to the invention, a separating partition 23, made of a dielectric material, is arranged between two adjacent conductive elements 21.

The separating partitions 23 are all identical to each other. They preferably have dimensions such that at all points on their periphery they protrude, in relation to a line connecting any point on the stripped portion of a conductive element 21 and the closest point of the stripped portion of an adjacent conductive element, with a height h at least equal to half the distance between those two points.

In the context of the embodiment illustrated in FIGS. 3 and 4, the separating parts 23 are attached on the surface of the body 17 of the connector 15. The separating pieces 23 could also be made in one piece with the body 17 of the connector 15 without going beyond the scope of the invention.

Figure 6:
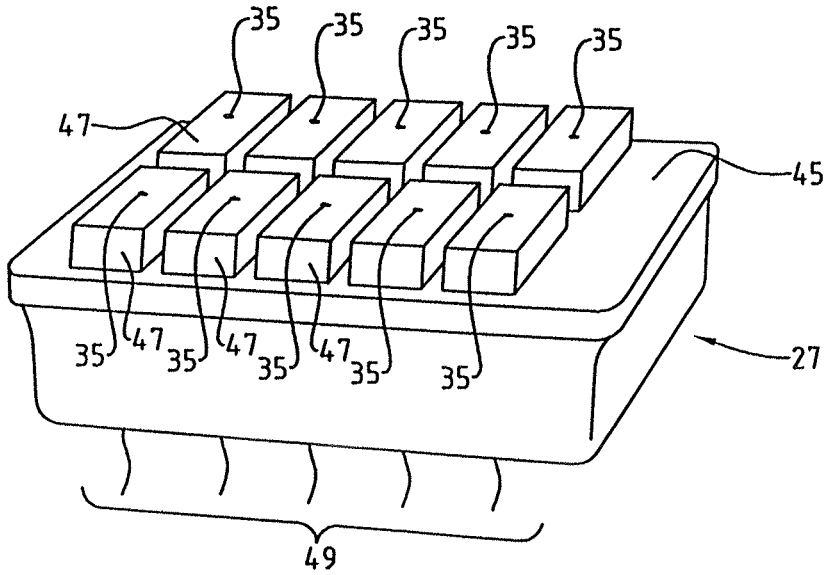
FIG. 6 is a perspective view of a female connector adapted to be connected to the male connector illustrated in FIG. 5.

FIGS. 5 and 6 illustrate another embodiment of the device according to the invention. FIG. 5 shows a male connector 25 and FIG. 6 shows the associated female connector 27.

The male connector 25 has plug-in connecting conductive elements 29 such as prongs that protrude from the surface 31 of a connector body 33 and are distributed on the surface 31 forming gridlines.

The plug-in connection elements 29 are conductive prongs each electrically connected inside the body 33 (using means not shown) to a sheathed electrical wire 36.

The connecting conductive elements 29 are adapted to be received in housings 35 formed in the female connector 27 illustrated in FIG. 6.

According to the invention, the connector 25 includes a separating partition 37 made of a dielectric material. The separating partition 37 assumes the form of a grid made up of a first series of dielectric separating plates or blades 39 aligned two by two transversely, on either side of a second series of dielectric separating plates or blades 41 aligned longitudinally and perpendicular to the separating plates 39.

Each dielectric separating plate 39, 41 is arranged between two conductive elements 29 of the connector 25, such that none of the conductive elements 29 are directly opposite an adjacent conductive element 29.

In parallel, in order to receive the conductive elements 29 of the male connector 25, the female connector 27 has terminals 47 (or contacts) with substantially parallelepiped shapes, which protrude in relation to a surface 45.

The dimensions and the spatial arrangement of the terminals 47 are complementary to the dimensions and arrangement of the spaces defined between the separating plates 39 and 41 of the dielectric separating partition 37 in grid form. Thus, the terminals 47 can easily be introduced into said spaces.

The terminals 47 thus form rows in lines and columns, and can each be opposite a conductive element 29 during the assembly of the male 25 and female 27 connectors.

The housings 35 in which the conductive elements 29 are inserted are made in each of the terminals 47, in the vicinity of their center, and electrically connected in the body 45 (using means not shown) to conductive wires 49 illustrated in FIG. 6.

All of the wires 49 have deliberately not been illustrated in FIG. 6 to facilitate reading thereof.

The height of the dielectric grid 37 in relation to the surface 31 is substantially equal to the height of the terminals 47.

When the conductive elements 29 are plugged into the housings 35 of the terminals 47, they still have a small stripped portion that is not engaged in the corresponding housing 35. This is due in part to imprecisions in the manufacture of the connectors.

The dimensions of the dielectric grid 37 are such that at any point it protrudes, in relation to a line connecting any point of the stripped portion of a conductive element 29 and the closest point of the stripped portion of an adjacent conductive element, with a height h at least equal to half the distance between those points.

Figure 7:
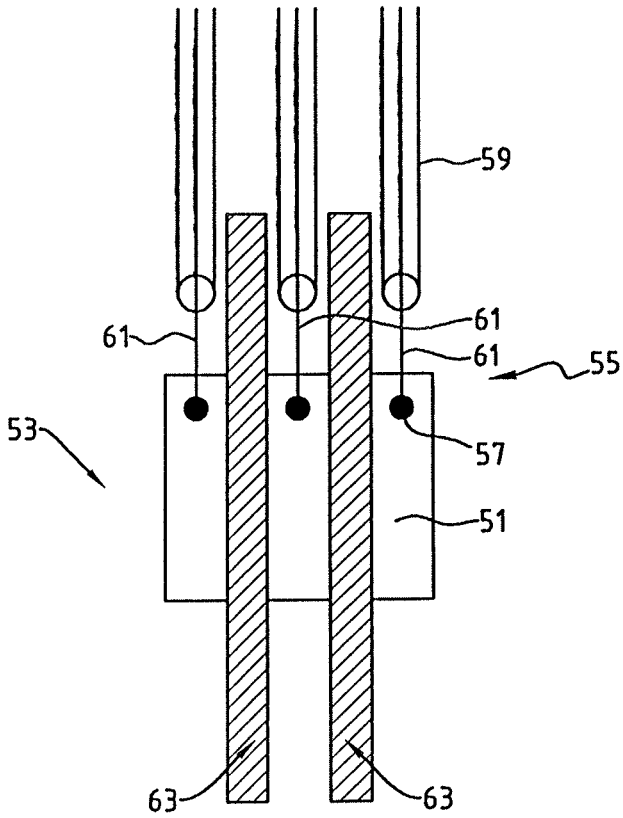
FIG. 7 is a diagrammatic partial cross-sectional view of another embodiment of the device according to the invention applied to a rotary multi-electrode system.

FIG. 7 illustrates still another embodiment of the device according to the invention applied to a multi-electrode rotary system.

FIG. 7 partially shows a revolving contactor 51 of a machine 53 such as an electric engine or a photovoltaic generator driving mechanism.

Conductive elements 55 are in contact at one of their ends 57 with the contactor 51.

The conductive elements 55 are provided with insulating sheaths 59 that leave a portion 61 of the conductive elements stripped adjacent to their end 57.

According to the invention, separating partitions 63 made of a dielectric material are inserted between two conductive stripped portions 61 of the opposite conductive elements.

The separating partitions 63 can be discs or blades integral with the contactor 61 or fastened thereon, and rotating with it.

In this way, the dielectric separating partitions 63 completely insulate each other from the stripped portions of the adjacent conductive elements 55.

Preferably, each separating partition 63 protrudes or overhangs beyond the stripped portions of the conductive elements 55 over a height at least equal to half of the shortest distance that separates the separating partition 63 from each of the stripped portions 61 of two adjacent conductive elements 55.

Thus, in the case of a collector or rotary contact electric motor, the protruding portions of the dielectric separating partitions 63 prevent the formation of an electric arc between the stripped portions of the conductive elements 55.

In the case where the body 51 has a solid cylinder shape, the separating partitions 63 protrude radially from the side wall of the body 51, which makes it possible to prevent the formation of an arc regardless of the position of the conductive elements 55 on the side wall of the body 51.

Figure 8:
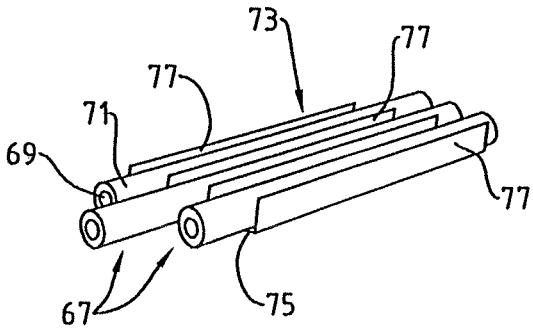
FIGS. 8 and 9 are diagrammatic perspective views of a separator system according to another embodiment of the invention.
Figure 9:
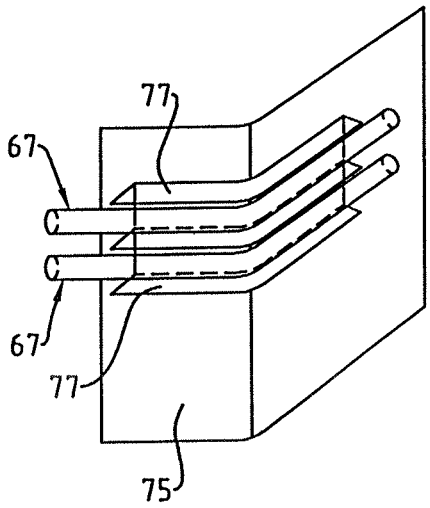

FIGS. 8 and 9 illustrate another embodiment of the device according to the invention applied to electrical conductors that do not have a stripped portion in the beginning of their lifetimes, but which are used under conditions where the stresses are likely to reveal a risk of damage of their insulant, for example cracking due to aging or wear against an edge because of vibrations, likely to cause the formation of an electric arc between two adjacent conductors.

The electrical conductors 67 include a conductive core 69 surrounded by an insulating sheath 71.

According to the invention, a conductor separator system 73 is made up of a bottom 75 on which separating partitions 77 stand, both made of dielectric material, and which define a set of parallel chutes with U-shaped sections adapted each to receive an electrical conductor. The separating partitions 77 each protrude or overhang beyond the conductive cores 69, which are likely to be more or less locally stripped by aging, wear, or accidentally for the reasons explained above, over a height preferably at least equal to about half of the shortest distance separating the separating partitions 77 of each of the conductive cores 69 of two adjacent conductors 67.

Once again, such a height of the partitions 77 is adapted to impose a slope of at least about 30° on an arc likely to form in relation to a direct path between conductive cores 69 that would be locally stripped for the reasons indicated above.

The invention claimed is:

1. A multi-electrode rotary system comprising:

a machine including a revolving contactor, at least two electrically conductive elements, each conductive element being provided with an insulting sheath and having a stripped portion at one of its ends, the stripped portion being in electrical contact with the revolving contactor, at least one separating partition made of dielectric material and inserted between the stripped portions of two adjacent conductive elements, the at least one separating partition overhanging beyond the corresponding stripped portions of the conductive elements over a height at least equal to about half of the shortest distance that separates the separating partition from each of the stripped portions.

2. The system according to claim 1, wherein the revolving contactor has a cylinder shape and the at least one separating partition protrudes radially from a side wall of the revolving contactor.

3. The system according to claim 2, wherein the at least one separating partition is a disk integral with the revolving contactor.

4. The system according to claim 2, wherein the at least one separating partition is a disk fastened to and rotating with the revolving contactor.

5. The system according claim 1, wherein the at least one separating partition is made from a ceramic material.

6. The system according to claim 1, wherein the machine is a photovoltaic driving mechanism.

7. The system according to claim 1, wherein the shortest path between the stripped portions of two adjacent conductive elements by bypassing the corresponding separating partition corresponds to an instability threshold for an electric arc that is likely to be established between the stripped portions of the two adjacent elements.

* * * * *